United States Patent [19]

Soule et al.

[11] Patent Number: 4,485,894

[45] Date of Patent: Dec. 4, 1984

[54] LIFT TRUCK MAST AND CARRIAGE ASSEMBLY

[75] Inventors: Eugene A. Soule; William L. Taylor; Robert H. Walker, all of Jackson, Mich.

[73] Assignee: The Knickerbocker Company, Jackson, Mich.

[21] Appl. No.: 381,064

[22] Filed: May 24, 1982

[51] Int. Cl.[3] ..... B66B 9/20

[52] U.S. Cl. ..... 187/9 E; 254/386

[58] Field of Search ..... 187/9 R, 9 E, 17; 182/141, 63; 254/385, 386, 387; 414/629

[56] References Cited

U.S. PATENT DOCUMENTS

| | | | |
|---|---|---|---|
| 1,964,273 | 6/1934 | Remde . | |
| 1,991,576 | 2/1935 | Remde . | |
| 2,261,930 | 11/1941 | Abbe . | |
| 2,569,126 | 9/1951 | Daniels . | |
| 2,787,338 | 4/1957 | Quayle | 187/9 E |
| 3,042,149 | 7/1962 | Comfort . | |
| 3,225,867 | 12/1965 | Inghram . | |
| 3,302,810 | 2/1967 | Heidrick | 414/629 |
| 3,390,797 | 7/1968 | Goodacre et al. . | |
| 3.407.950 | 10/1968 | Ward et al. . | |
| 3,561,621 | 2/1971 | Rivers, Jr. . | |
| 3,563,341 | 2/1971 | Bultman . | |
| 3,710,424 | 1/1973 | Smejkal et al. | 254/385 |
| 3,710,965 | 1/1973 | Joosten . | |
| 3,799,379 | 3/1974 | Grether et al. . | |
| 3,826,393 | 7/1974 | Carroll . | |
| 3,908,849 | 9/1975 | Carroll . | |
| 3,972,388 | 8/1976 | McVeen . | |
| 4,061,237 | 12/1977 | Austin et al. . | |

OTHER PUBLICATIONS

"On-Board Lift Truck Adds Value to Beer Distribution", by Wolfgang Nordhorn.
Modern Materials Handling/Jun. 1977-373-376.

*Primary Examiner*—Joseph J. Rolla
*Assistant Examiner*—Kevin P. Shaver
*Attorney, Agent, or Firm*—Barnes, Kisselle, Raisch, Choate, Whittemore & Hulbert

[57] ABSTRACT

A power-up and power-down mast and carriage assembly for a lift truck of the type having a stationary mast section fixed to the truck, a movable inner mast section reciprocable within the stationary mast, a fork carriage movably associated with the inner mast section, a double-acting hydraulic ram having an extensible and retractable cylinder and piston rod assembly operatively connected between said mast sections for extending and retracting the inner mast section relative to the stationary mast section. Lost-motion couplings interconnect both power-up and power-down chains with the stationary mast and carriage in a closed loop chain rigging system. The lost-motion couplings each have a rod slidably through the interconnection with the carriage and stationary mast, and spaced stops operable to limit travel of the rod to a predetermined distance. Coil springs connected to the rod yieldably bias the chains so as to exert tension thereon in a direction opposite to the load forces imposed on the chains by the ram. The lost-motion predetermined travel distance preferably is equal to the sum of the travel of the lost-motion coupling of the powered chains during initial application of ram-applied forces thereto plus the maximum elongation of the powered chains under maximum rated load so that the non-powered chains are always maintained in taut condition in both power-up and power-down modes of operation of said mast.

7 Claims, 8 Drawing Figures

Fig-6
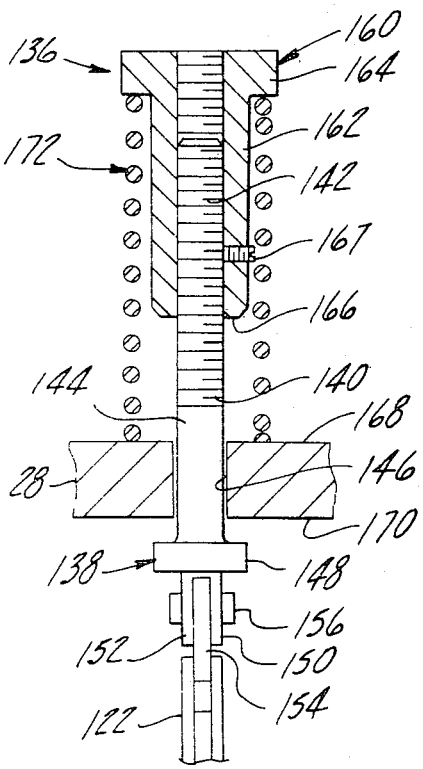
Fig-7
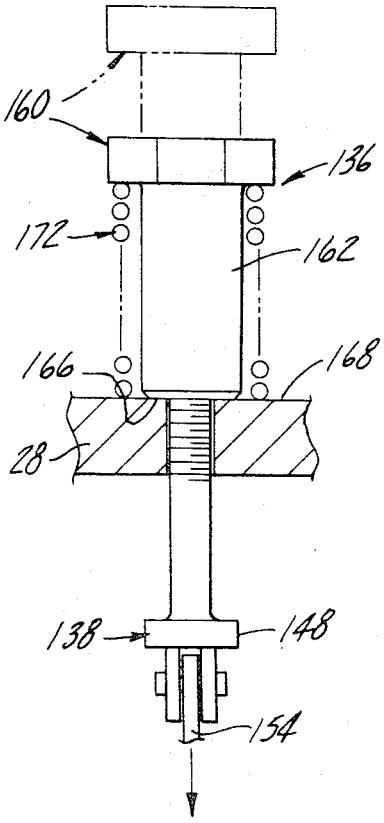
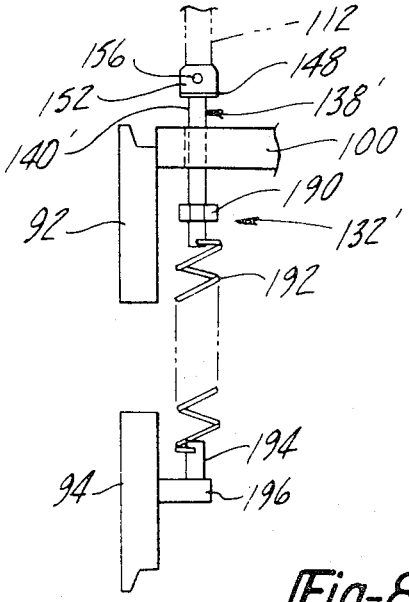
Fig-8

LIFT TRUCK MAST AND CARRIAGE ASSEMBLY

This invention relates to fork lift trucks, and more particularly to a power-up and power-down mast and carriage assembly for a lift truck.

In many applications of material handling using fork lift trucks it is desirable to provide a fork lift truck which has the capability of using its own power to lift itself onto and off of the bed of a truck or carrier so that the fork lift truck may be transported from site to site to perform lifting jobs. Such "piggyback" lift trucks are preferably designed so that a single operator can load and unload a fork lift truck onto and off of the cargo bed of the same carrier which is used to carry the load requiring the services of the fork lift truck. Power-up and power-down type lift truck masts are also desirable for use with special attachments on off-road lift trucks, such as for auger and drilling operations. Some examples of prior art self-loading fork lift trucks are those shown in the U.S. Pat Nos. to Heidrick 3,302,810, Goodacre et al 3,390,797, Ward et al 3,407,950, Grether et al 3,799,379, Carroll 3,826,393 and Carroll 3,908,849.

It is preferred to provide as much load lifting range as possible in such a power-up and power-down mast, to hydraulically power the mast with a hydraulic ram and to elevate the fork lift carriage on the mast with a chain system powered by the ram, either directly or through mast extension and contraction. It is also preferred to utilize components which are conventional in lift truck manufacture and hence readily available and adaptable to the existing hydraulic pumps, valving and controls normally provided on conventional lift trucks and on similar off-road equipment such as end loaders and the like.

Although the aforementioned Heidrick U.S. Pat. No. 3,302,810 shows a two-stage mast operated by a double-acting simplex ram and a carriage movable on the inner mast operated by a pair of lifting chains and a pair of pull-down chains, it has been found in accordance with the present invention that attempting to adapt such a load-lifting and piggyback mast to heavy duty and rough terrain use, while employing standard lift truck mast type components, a serious problem of chain stretch and elongation can and does occur in the powered side of the closed chain loop, resulting in undesirable chain slack in the non-powered side which in turn can cause chain slack, chain derailment and undue shock loading in the chain system and associated components.

Accordingly, it is an object of the present invention to provide a lift truck mast and carriage assembly capable of power-up and power-down operation throughout a full load lifting height of a two-stage mast, capable of lifting a full size lift truck in a piggyback mode on an associated cargo carrier utilizing a hydraulic simplex ram of the double acting type, and a chain rigging system which avoids the aforementioned problems of chain slack in the non-powered side of the chain loop, all in a simple, reliable and economical manner.

Another object is to provide a lift truck mast of the aforementioned character which is capable of a wide variety of power-up and power-down applications and which is alternately cyclable between power-up and power-down modes at any point of the travel carriage and mast, which is capable of auto-lifting the fork truck into a carrier cradle for transporting the lift truck from one location to another in piggyback mode with the carriage fully lowered on the fully collapsed mast with the lift truck at the elevation of the forks of the carriage.

A further object is to provide a chain tensioning system useful in lift truck masts which is capable of reducing instantaneous shock loads on the chain and associated components under bounce loading stresses, and which is readily adaptable to accommodate chain stress conditions encountered in the given mast design.

Other objects, features and advantages of the present invention will become apparent from the following detailed description taken in conjunction with the accompanying drawings wherein:

FIG. 1 is a simplified semi-schematic elevational view taken generally in vertical center section of a mast and carriage assembly embodying the invention shown raised to its full lift position in a power-up mode, with a fragmentary phantom showing of an associated lift truck onto which the mast and carriage assembly is intended to be mounted for use therewith.

FIG. 2 is a simplified semi-schematic elevational view of the lift truck having the mast and carriage assembly mounted thereon, with the lift truck shown in solid line position raised off the ground by operation of the mast and carriage assembly in the power-down mode, the carriage forks being inserted within the fork receivers provided at the rear of a flat bed of a cargo truck for piggyback transport of the lift truck and mast.

FIG. 6 is a fragmentary, vertical center sectional view of one cmbodiment of a lost motion coupling chain tensioning means connecting the power-down chains with the cross brace member of the outer stationary mast assembly, the connector being shown in intermediate position.

FIG. 7 is a view of the lost motion coupling means of FIG. 6 shown shifted to bottomed or positive stop position in response to ram forces being applied to the chain in the power-down force application mode.

FIG. 8 is a fragmentary, schematic illustration of a modified embodiment of lost motion chain tensioning coupling means of the invention.

Figure 1:
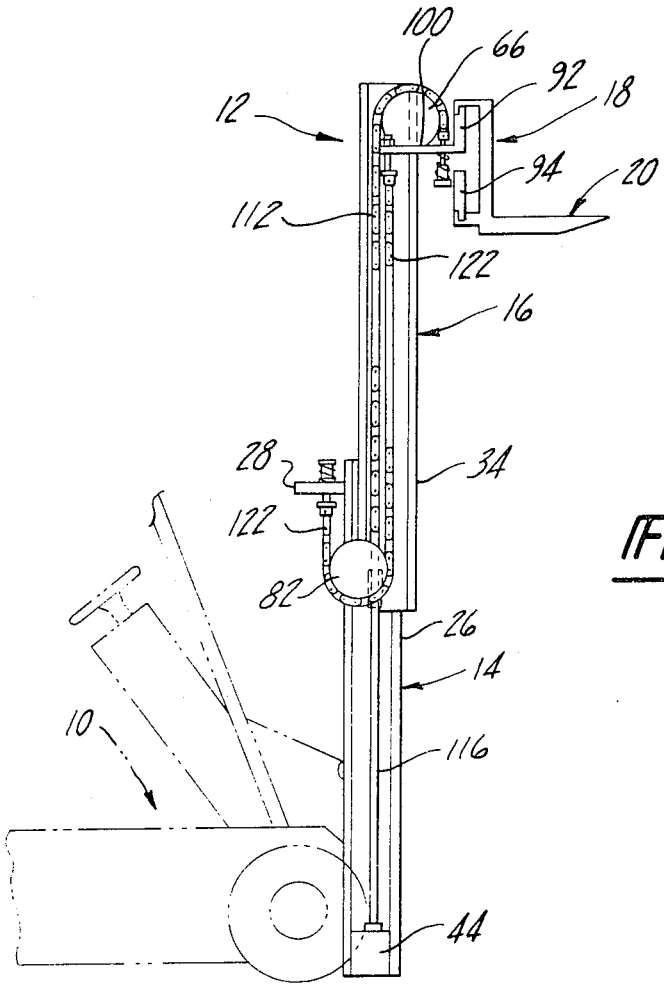

Referring in more detail to the accompanying drawings, FIG. 1 illustrates in a fragmentary phantom showing a conventional rough terrain lift truck 10 having mounted at the front end thereof a mast and carriage assembly of the power-up, power-down type embodying an exemplary but preferred form of the present invention, the mast and carriage assembly being shown in solid lines. The mast and carriage assembly 12 preferably comprises a two-stage roller-type mast consisting of a stationary, outer and lower mast section 14, a movable inner and upper mast section 16 and a fork carriage 18 having load lifting forks 20 and mounted by suitable rollers on inner mast section 16. The mast and carriage assembly is powered by a suitable two-stage ram 22, having a cylinder 40 and a piston 52, of the double-acting type such as that shown in the Goodacre et al U.S. Pat. No. 3,390,797 and which is well known in the art. Ram 22 is shown in FIGS. 3, 4 and 5, the same being deleted from FIG. 1 for clarity of illustration.

Figure 3:
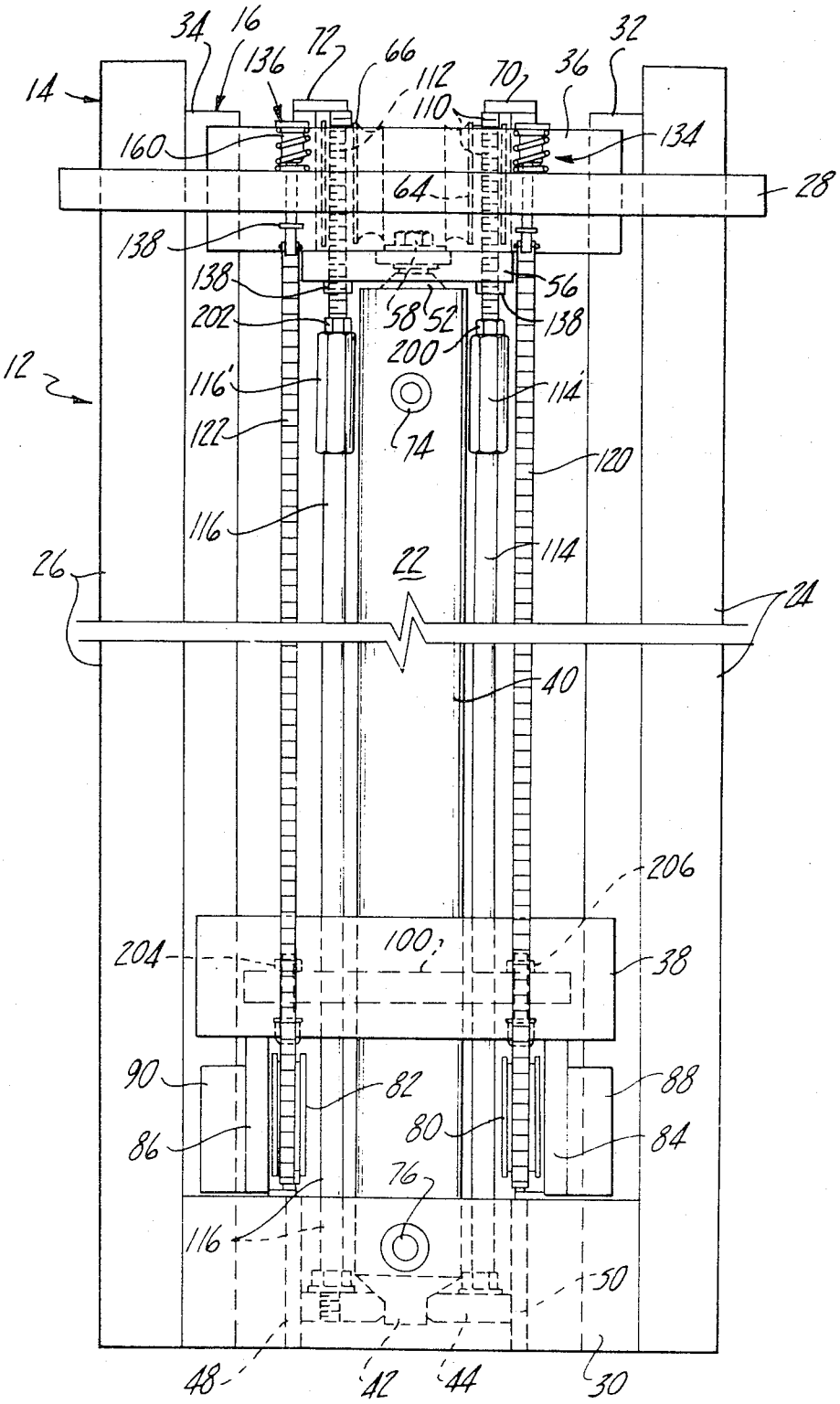
FIG. 3 is a vertical, fragmentary elevational view taken from the rear side of a mast and carriage assembly embodying the invention, portions of the complete assembly being omitted for clarity of illustration.
Figure 4:
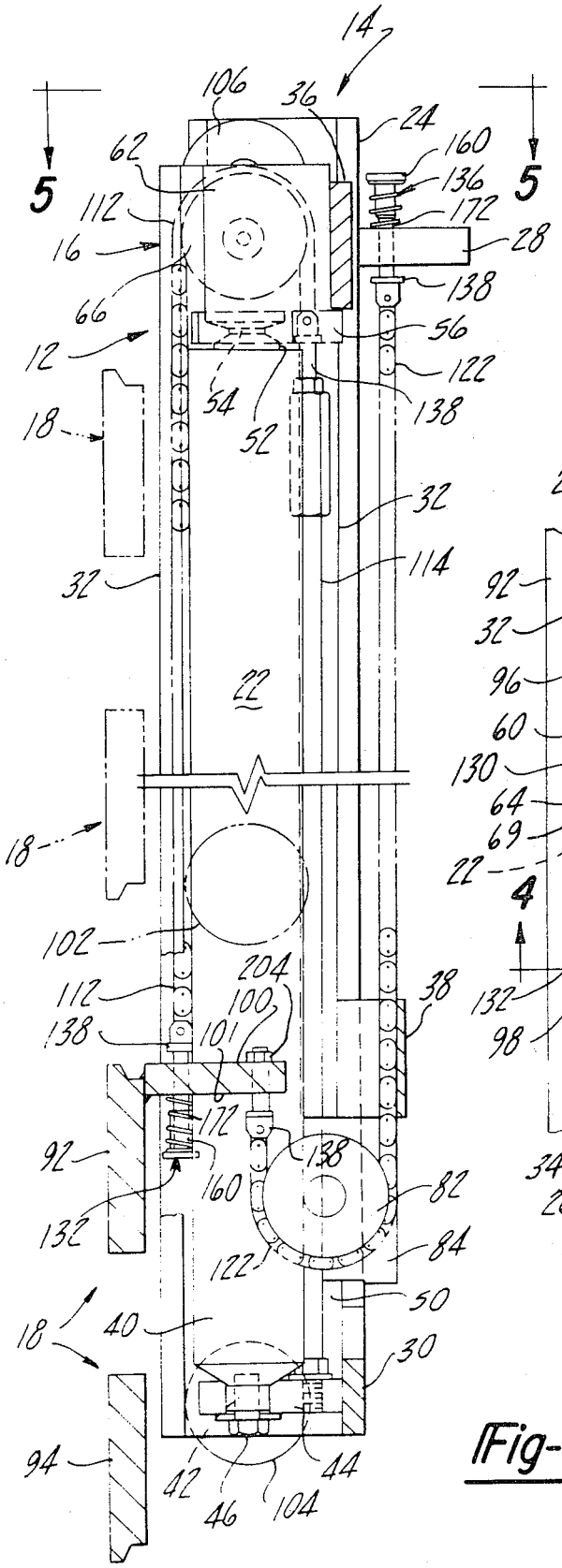
FIG. 4 is a side vertical sectional view of the mast and carriage assembly of FIG. 3 taken generally on the line 4—4 of FIG. 5 with a portion of the carriage structure shown in solid lines in lowermost position, the raised position of the carriage on the inner mast being shown in phantom lines, and the mast being shown with the inner and outer mast sections in fully collapsed relationship.
Figure 5:
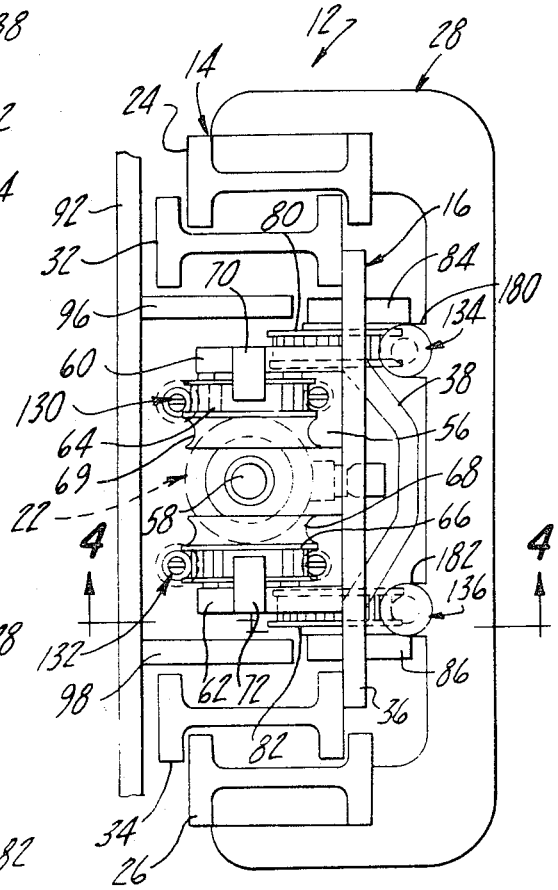
FIG. 5 is a top plan view, looking in the direction of the arrows 5—5 of FIG. 4, of the mast and carriage assembly of FIGS. 3 and 4, with certain elements of the mast and carriage assembly being omitted for clarity of illustration.

Referring in more detail to FIGS. 3, 4 and 5, stationary mast section 14 is made up of a pair of upright I-beam rails 24 and 26 connected near their upper ends by a rear cross brace 28 and at their lower ends by a rear cross brace 30. Similarly, the movable inner mast section 16 includes a pair of upright I-beam rails 32 and 34 connected at their upper ends by a cross brace 36 and near their lower ends by a cross brace 38.

The lower end of cylinder 40 of ram 22 has a nose 42 seated in a horizontal mounting plate 44 of stationary mast section 14 (FIGS. 3 and 4). Nose 42 receives a mounting stud 46 which detachably secures cylinder 40 to plate 44. Plate 44 in turn is welded at its opposite ends to a pair of upright plates 48 and 50 which are welded at their rear edges to cross brace 30. The upper end of piston 52 of ram 22 likewise has a nose 54 seated in a plate 56 of inner mast section 16 and detachably secured thereto by a mounting stud 58. The rear edge of plate 56 underlies and is welded to the bottom edge of cross brace 36. A pair of upright plates 60 and 62 are welded at their bottom edges onto plate 56 and are welded at their rearward edges to cross brace 36 to help brace plate 56 and also to provide journal supports for a pair of chain sheaves 64 and 66. If desired, hose sheaves 68 and 69 may be disposed between sheaves 64 and 66 and independently journalled upon plates 60 and 62 respectively. A pair of chain protector tabs 70 and 72 are mounted on the upper edges of plate 60 and 62 respectively so as to overlie sheaves 64 and 66 respectively.

Ram 22 has hydraulic two-way fluid connections 74 and 76 near its upper and lower ends respectively for feeding working fluid to and from the upper and lower working chambers of ram 22 for actuating the same in its power-down and power-up modes respectively.

Another pair of chain sheaves 80 and 82 are respectively journalled on upright support plates 84 and 86 which have their upper edges seated under and welded to the lower edges of cross brace 38. The outer sides of plates 84 and 86 are welded to plates 88 and 90 respectively (FIG. 3), which in turn are welded against the rear faces of rails 32 and 34 respectively.

Carriage assembly 18 has a pair of upper and lower horizontal carrier rails 92 and 94 interconnected by vertical struts 96 and 98 (shown only in FIG. 5). A horizontal cross member 100 is welded upon the upper edges of struts 96 and 98 and is welded along its front edge to the upper edge of rail 92. Carriage 18 is movably guided for vertical travel along the length of inner mast rails 32 and 34 by two pairs of vertically spaced guide rollers, only one pair of such rollers 102 and 104 being shown in FIG. 4. The carriage rollers are rotatably journal supported on carriage struts 96 and 98 and are disposed to track in the mutually facing inner channels of the I-beam rails 32 and 34. Likewise, inner mast guide rollers are journal supported on the inboard sides of outer rails 24 and 34 in the space between the internested rails 24 and 32 and 26 and 34 for movably guiding travel of inner mast 16 in telescopic relation to outer mast 14. One such mast roller 106 is shown in FIG. 4, but the remainder of such rollers are omitted from FIGS. 3 and 5 since their structure and function are well known in the art. Also, it is to be understood that mast 12 could alternately be a slider type mast rather than being roller guided.

In accordance with one feature of the invention, a pair of load-lifting, power-up chains 110 and 112 are trained over sheaves 64 and 66 respectively, the forward runs of chains 110 and 112 extending downwardly to a connection with carriage 18 and the rearward runs of chains 110 and 112 extending downwardly and being connected at their lower ends to a pair of chain tie rods 114 and 116 respectively. Rods 114 and 116 are secured at their lower ends to the bottom plate 44 of outer mast section 14. Another or second set of load-lifting, power-down chains 120 and 122 are trained under sheaves 80 and 82, the rearward runs of chains 120 and 122 extending upwardly from the sheaves to a connection with the upper cross brace 28 of outer stationary mast 14 and the forward runs of chains 120 and 122 extending upwardly to a connection with cross member 100 of carriage 18. As explained in more detail hereinafter, the lower end of each of the forward runs of the power-up chains 110 and 112 has a lost-motion, yieldably biased connection to carriage 18, and the rearward runs of chains 110 and 112 each have an adjustable but fixed connection via tie rods 114 and 116 with stationary mast section 14. The forward runs of the power-down chains 120 and 122 have an adjustable but fixed connection to carriage 18, and the rearward runs of chains 120 and 122 have a lost-motion, yieldably biased connection with cross member 28 the stationary mast 14. Such lost-motion connections are provided by four identical lost-motion coupling assemblies 130,132,134 and 136, the details of which are best seen in FIGS. 6 and 7.

Referring to FIG. 6, the lost-motion coupling assembly 136 associated with the upper end of the rear run of power-down chain 122 is shown in a non-powered condition. Coupling 136 includes a chain anchor rod 138 having a shank 140 with external threads 142 provided at its upper end and a smooth, unthreaded portion 144 which extends slidably through a bore 146 in cross brace 28. The lower end of anchor rod 138 has a head 148 with clevis ears 150 and 152 dependent therefrom, the end link 154 of chain 122 being received between ears 150 and 152 and pivotally connected thereto by an anchor pin 156. Coupling 136 also includes a spring retainer 160 which consists of an internally threaded sleeve 162 threadably received on the threaded portion 142 of anchor rod 138. The upper end of sleeve 162 has an enlarged head 164 provided with suitable wrench flats and the lower end of sleeve 162 has a flat end face 166 adapted to abut the upper surface 168 of cross brace 28 to provide a stop for positively limiting downward movement of coupling 136 relative to cross brace 28 (as shown in FIG. 7). Retainer 160 is held fixed against rotation by a set screw 167. Upward movement of coupling 136 relative to cross member 28 is positively limited by head 148 of anchor rod 138 abutting the undersurface 170 of cross brace 28. A compression coil spring 172 encircles shank 140 of rod 138 and sleeve 162, the upper convolution of spring 172 abutting the underside of head 164, and the lowermost convolution of spring 172 seating upon the upper surface of 168 of cross member 28. Spring 172 exerts a yieldable biasing force upon rod 138 in an upward direction as shown in FIGS. 6 and 7 to provide a tension force on chain 122 in a direction opposite to the load forces applied to the chain by ram 22.

It will be understood that lost-motion couplings 134 and 136 are disposed as shown in FIGS. 3, 4 and 5 in forwardly extending ears 180 and 182 (FIG. 5) of upper cross brace 28 to yieldably couple chains 120 and 122 thereto. Likewise, lost-motion couplings 130 and 132 are mounted in spaced apertures in the carriage cross member 100, as shown in FIGS. 4 and 5, with the associated springs 172 exerting a downward biasing force on chains 110,112 i.e., in a direction opposite to the load forces imposed on chains 110 and 112 by ram 22. Power-up chains 110,112 are thus yieldably anchored at their lower ends to carriage 18 by couplings 130 and 132. The pull-down chains 120 and 122 have a similar yieldable take-up yield connection at their upper ends to rear cross brace 28 of the stationary mast 14.

In the operation of the structure thus far described, carriage 18 tracks vertically upon inner mast section 16 and is respectively raised and lowered by the power-up, lifting chains 110,112 and the power-down, pull-down chains 120 and 122. Assuming mast 12 is collapsed in its fully telescoped condition as shown in FIGS. 3 and 4, and carriage 18 is at its lowermost level as shown in these figures, controlled extension of ram 22 produces a direct 1-to-1 extension of inner mast 16 upwardly on outer mast 14 as piston 52 is forced upwardly relative to cylinder 40 by hydraulic fluid being forced into the lower working chamber of the ram while hydraulic fluid is released from the upper working chamber. As inner mast 16 moves upwardly on outer mast 14, the inner mast sheaves 64 and 66 take up the lifting chains 110 and 112 and raise carriage 18 at 2-to-1 ratio to mast extension. Since the pull-down or power-down chains 120 and 122 form a "closed loop" with the power-up lifting chains 110 and 112, chains 120 and 122 are paid out to track upward carriage movement at the same rate as take-up of the lifting chains 110 and 112.

In accordance with the present invention, during this power-up as well as the power-down mode of operation, both sets of chains are continuously maintained in a taut condition by the biasing forces exerted by the four springs 172 regardless of the load forces imposed on the chains. Thus, assuming power-up mode of operation, and with a load placed on forks 20 of carriage 18, as soon as ram 22 applies a load lifting force to chains 110 and 112, couplings 130 and 132 are moved upwardly relative to carriage cross member 100, against the biasing force of the associated springs 172, until spring retainers 160 abut the undersurface 101 of cross member 100. This yieldable lost-motion connection thus represents a predetermined first increment of chain lengthening relative to chains 110,112, thereby lengthening the effective length of the closed chain loop. This tends to slacken the power-down chains 120 and 122 because chain rollers or sheaves 80 and 82 begin to move upwardly with initial upward movement of inner mast 16 without a corresponding movement of carriage cross member 100. However, this slackening effect is countered by the spring take-up of couplings 134 and 136 which, under the influence of their associated biasing springs 172, are forced upwardly a distance sufficient to maintain chains 120 and 122 taut.

Once the lost-motion of couplings 130 and 132 is taken up during initial extension of ram 22, carriage 18 will be lifted and full load stress applied to chains 110 and 112. This stress exerted on the power-up lifting chains will produce some stretch therein which, in turn, would tend to produce further slack in the power-down chains 120 and 122 but for the slack pick-up action caused by the spring take- up, lost-motion connection of pull-down chains 120 and 122 to outer mast 14 via the couplings 134 and 136. Hence, these couplings will be forced further upwardly by their associated springs 172 to further maintain the unloaded side of the closed chain loop in taut condition.

Figure 2:
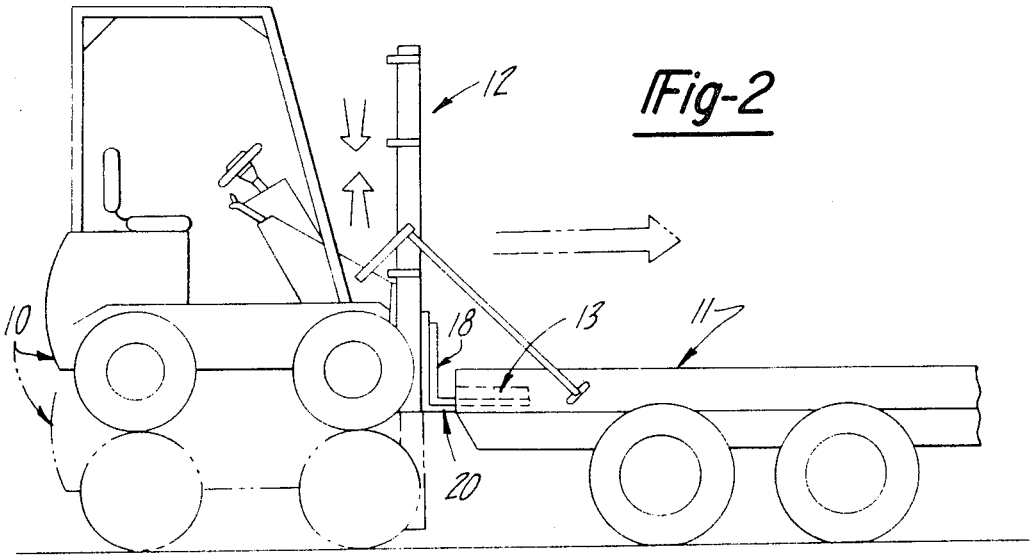

Since ram 22 is double-acting, it is capable of directly pulling inner mast down on outer mast 14, which in turn, produces a power-down action on carriage 18 via pull-down chains 120,122, again the carriage motion being at a 2-to-1 ratio to mast retraction. When employing mast 12 for piggyback elevation of lift truck 10 onto the rear of associated cargo truck 11 as shown in FIG. 2, fixing of the carriage forks 20 into a suitable socket support structure 13 at the rear of the flat bed of cargo truck 11 enables mast assembly 12 and associated lift truck 10 to be suspended from carriage 18 via the pull-down chains 120 and 122. In this mode the power-up or lifting chains 110 and 112 are unstressed because the inner and outer mast sections 16 and 14 are tied together by ram 22. Assuming lift truck 10 is at ground level as shown in phantom in FIG. 2, applying power-down operation to ram 22 will raise cylinder 40 on piston 52 to thereby lift outer mast 14 upwardly on inner mast 16 at a 1-to-1 ratio to ram contraction. The take-up of the pull-down chains 120 and 122 in response to mast contraction causes inner mast 16 to be raised on carriage 18 at a 1-to-1 ratio to ram contraction, thereby elevating outer mast 14 relative to the fixed carriage 18 at a 2-to-1 ratio. When mast 12 is fully contracted, inner mast 16 will have been raised all the way up on carriage 18 and outer mast 14 along with lift truck 10 will have been fully raised on inner mast 16. This sequence will thus raise the lift truck 10 from the phantom line to the solid line position shown in FIG. 2 wherein truck 10 is well clear of the ground and ready for securement and transport in piggyback fashion at the rear of the associated cargo truck 11.

It will be noted that, due to the center of gravity of the lift truck in the piggyback mode being at about the elevation of the forks 20 of the carriage, the length of the moment arm between the center of gravity of the lift truck 10 and forks 20 is comparable to that obtained with present commercial piggyback lift-truck-type materials handlers, such as those shown in U.S. Pat. Nos. 3,826,393 and 3,908,849, and yet the maximum load lifting height of mast 12 is twice that of such commercial piggyback units.

During the aforementioned power-down piggyback hoisting of mast 12 and lift truck 10, the stretching of the power-down chains 120 and 122 resulting from such stress loading would produce slack in the non-powered side of the closed chain loop, i.e., in the power-up lifting chains 110 and 122, but for the spring take-up tensioning of the lifting chains through their associated lost-motion connections with carriage 18 via couplings 130 and 132. Since the loads imposed on the power-down chains 120,122 during piggyback operation are roughly comparable to the loads imposed on lifting chains 110,112 during normal rated power-up load lifting, chain stretch in the alternately stressed two-halves the chain loop is roughly equal and also of considerable magnitude. Due to the spring chain tensioning feature of the present invention, the problem of chain slack and chain derailment is overcome in all modes of operation in a very simple and economical fashion.

Referring to FIG. 8, an alternative form of lost-motion spring coupling for chain slack take-up is illustrated ih semi-schematic fragmentary form. In this embodiment, the lost-motion coupling assembly 132' is shown associated with carriage 18, and more particularly with carrier rails 92 and 94 thereof. Coupling 132' includes a modified chain anchor rod 138' connected by pin 156 and clevis ears 150,152 to the power-up chain 112. Shank 140' of chain anchor 138' extends slidably through the carriage cross member 100 and is threaded at its lower end to receive a stop nut 190. A tension coil spring 192 is suitably secured at its uppermost convolution to the lower end of rod 138', as by insertion of an end tang of the convolution through an aperture in shank 140'. The lower end of spring 192 is likewise secured to a pin 194 fixed to a bracket 196 secured to the rear face of carriage rail 94. Spring 192 thus is arranged to exert a tension force on chain 112 via chain anchor rod 138' in a direction opposite to the load forces imposed on the chain by ram 22. The spacing between the head 164 of anchor 138' and nut 190 is adjustable and normally set to a predetermined distance corresponding to that between head 148 of anchor rod 138 and the shoulder face 166 of spring retainer 160 of the previously described lost-motion coupling 136. Hence, when load stresses are applied to chain 112, spring 192 is stretched until nut 192 abuts the undersurface of carriage cross member 100.

The non-powered side of the chain loop, i.e., in this instance, the power-down chains 120,122, are maintained taut when equipped with the modified lost-motion couplings 132' by the tension springs 192 thereof pulling their associated anchor rods 138' of the slackened chains to take up the spacing between the head 148 of the anchor rod and the associated cross member 28. Thus, the modified embodiment of the lost-motion coupling 132', when substituted for the aforementioned couplings 130,132,134 and 136, functions in the same manner to provide chain tensioning springs on each side of the alternately ram-powered half-loops of the closed loop chain power-up and power-down chain rigging system of the invention.

From the foregoing description, it will now be understood that the present invention provides a lost-motion, positive stop connection to the carriage on the power-up side of the loop, providing spring bias take-up on the unloaded power-down side of the loop which is sufficient to take up both the lost-motion in coupling and the chain stretch, and vice-versa in the power-down mode of operation. It will also be understood that the effective length of each set of chains 110,112 and 120,122 may be readily adjusted by the threaded connection of the associated chain anchor rods 138 to the associated tie rods 114 and 116 (in the case of the power-up chains 110 and 112), and to carriage cross member 100 (in the case of power-down chains 120,122). Thus, as shown in FIGS. 3 and 4, anchor rods 138 of chains 110,112 thread into sleeves 114' and 116' of tie rods 114 and 116 respectively, and are locked in place by associated nuts 200 and 202 respectively. Likewise, anchor rods 138 associated with chains 120 and 122 (FIGS. 3 and 4) are adjustably fixed by nuts 204 and 206 to carriage cross member 100. This adjustment is intially set up at the factory to accommodate the chain stress or elongation encountered under test at rated loads, such that uniform and balanced application of lifting forces in both the power-up and power-down mode is achieved through the chain rigging system. However, the same chain take-up adjustment may be readily employed during field servicing when normal chain and sheave wear has occurred after extended field use of the lift truck and carriage assembly of the invention.

It will also be understood that various features of the invention have been particularly shown and described. However, based upon the foregoing description and drawings, it will be obvious to one skilled in the art that modifications may be made to the illustrated embodiment without departing from the scope of the invention. For example, the lost-motion couplings 130 and 132 for the power-up chains 110 and 112 may be located at the connections of the associated tie rods 114 and 116 with brace 44, and adjustable, fixed connection of these chains made to carriage cross member 100. Likewise, couplings 134 and 136 may be interposed between carriage cross member 100 and the power-down chains 120 and 122, and the adjustable fixed connection of these chains made to cross brace 28. As a further modification, particularly for extra long chain runs, lost-motion couplings may be provided at each of the ends of the power-up and power-down chain runs. However, the embodiment of the invention illustrated herein is presently preferred for convenience of manufacture and service.

We claim:

1. In a power-up and power-down mast and carriage assembly for a lift truck of the type having a stationary mast section fixed to the truck, a movable inner mast section reciprocable within the stationary mast, a fork carriage movably associated with the inner mast section, a double-acting hydraulic ram having an extensible and retractable cylinder and piston rod assembly operatively connected between said mast sections for extending and retracting the inner mast section relative to the stationary mast section, first sheave means rotatably mounted adjacent the upper end of said inner mast section for bodily movement therewith, power-up chain means trained over said first sheave means and having one end attached to said fork carriage and the other end attached to said stationary mast, second sheave means rotatably mounted on said inner mast section adjacent the lower end thereof for bodily movement therewith, power-down chain means trained under said second sheave means and having one end attached to said fork carriage and the other end attached to said stationary mast, whereby said power-up and power-down chain means are respectively powered and nonpowered in the power-up mode, and vice-versa, the improvement comprising first lost-motion coupling means interconnecting said power-up chain means with said stationary mast and said carriage, and second lost-motion coupling means interconnecting said power-down chain means with said stationary mast and said carriage, said first and second lost-motion coupling means each having spaced stop means operable to positively limit lost-motion travel of the associated said lost-motion coupling means to a predetermined distance, and biasing means operably connected to said lost-motion coupling means for yieldably biasing said chain means so as to exert tension thereon in a direction opposite to the load forces imposed on said chain means by said ram, said predetermined travel distance being equal to the sum of the travel of the lost-motion coupling of the powered chain means during initial application of ram-applied forces thereto plus the maximum elongation of the powered chain means under maximum rated load whereby the non-powered chain means is always maintained in taut condition in both power-up and power-down modes of operation of said mast.

2. In a mast and carriage assembly for a lift truck of the type having a stationary mast section fixed to the truck, a movable inner mast section reciprocable within the stationary mast, a fork carriage movably associated with the inner mast section, a double-acting hydraulic ram having an extensible and retractable cylinder and piston rod assembly operatively connected between said mast sections for extending and retracting the inner mast section relative to the stationary mast section, first sheave means rotatably mounted adjacent the upper end of said inner mast section for bodily movement therewith, power-up chain means trained over said first sheave means and having one end attached to said fork carriage and the other end attached to said stationary mast, second sheave means rotatably mounted on said inner mast section adjacent the lower end thereof for bodily movement therewith, power down chain means trained under said second sheave means and having one end attached to said fork carriage and the other end attached to said stationary mast, the improvement comprising first lost motion coupling means interconnecting said power-up chain means with said stationary mast and said carriage, and second lost-motion coupling means interconnecting said power-down chain means with said stationary mast and said carriage, said first and second lost-motion coupling means each having rod means extending slidably through the interconnection thereof with said carriage and stationary mast, spaced stop means operable to limit travel of said rod means to a predetermined distance and spring means for yieldably biasing said chain means so as to exert tension thereon in a direction opposite to the load forces imposed on said chain means by said ram, said carriage and said stationary mast section each having a chain anchoring cross member, said first lost-motion coupling means connecting said one end of said power-up chain means to said carriage cross member, said second lost-motion coupling means connecting said other end of said power-down chain means to said stationary mast cross member, each said rod means of said lost-motion coupling means including an anchor rod connected to the associated chain end and extending slidably through the associated cross-member, said stop means comprising a pair of spaced stop means on each said anchor rod disposed one on each of the opposite sides of the associated cross member to limit travel of said rod therein to a predetermined distance, said spring means comprising first and second coil springs operatively coupled respectively between said carriage and associated anchor rod and between said stationary mast and associated anchor rod for yieldably biasing said chain means so as to exert tension thereon in a direction opposite to the load forces imposed on said chain means by said ram.

3. The combination as set forth in claim 2 wherein said ram cylinder is fixed at its lower end to a cross brace of said stationary mast and wherein the upper end of said ram piston rod is fixed to a cross brace of said inner mast whereby said ram acts directly on said mast sections to directly exert extension and retraction forces thereon in the power-up and power-down modes respectively, said carriage being adapted to move up and down on said inner mast for substantially the full length thereof.

4. The combination set forth in claim 2 wherein one of said spaced stop means comprises a flange on said anchor rod on the chain side of the associated cross member, said anchor rod having a shank portion extending through and slidable in the cross member and having a threaded portion at the end thereof remote from said flange, a spring retainer sleeve threadably received on said threaded portion of said rod and having a head portion at the end thereof remote from said cross member, the end of said retainer sleeve remote from said sleeve head being spaced from the associated cross member and abutted therewith to provide the other of said spaced stop means, said coil spring comprising a compression coil spring encircling said rod and sleeve and abutting at one end against said sleeve head and against said cross member.

5. The combination set forth in claim 2 wherein one of said spaced stop means comprises a flange on said anchor rod on the chain side of the associated cross member, said anchor rod having a shank portion extending through and slidable in the cross member and having a threaded portion at the end thereof remote from said flange, the other one of said spaced stop means comprising a nut threadably received on said threaded portion of said rod, and wherein said first coil spring comprises tension spring connected at one end to the free end of said associated anchor rod and extending away therefrom and having its axially opposite end connected to said carriage at a point remote from said associated cross member, said second coil spring likewise comprising a tension coil spring having one end connected to the free end of the associated anchor rod and extending away therefrom and having its axially opposite end connected to said stationary mast at a point remote from the associated cross member.

6. The combination set forth in claims 2, 4 or 5 wherein said carriage cross member comprises a plate secured to said carriage and extending transversely between the spaced upright rails of said inner mast section and said stationary mast cross member comprises a cross brace secured to the spaced rails of the stationary mast near the upper end thereof and extending across the rearward side of said mast.

7. The combination set forth in claims 2, 4 or 5 wherein said predetermined distance of said spaced stop means is equal to the sum of the travel of the lost-motion coupling of the powered chain means during initial application of ramapplied forces thereto plus the maximum elongation of the powered chain means under maximum rated load whereby the non-powered chain means is always maintained in taut condition in both power-up and power-down modes of operation of said mast.

* * * * *